US007497218B2

(12) United States Patent
Gueret

(10) Patent No.: US 7,497,218 B2
(45) Date of Patent: Mar. 3, 2009

(54) DEVICE AND METHOD FOR CURLING EYELASHES

(75) Inventor: Jean-Louis H. Gueret, Paris (FR)

(73) Assignee: L'Oréal S.A., Paris (FR)

( * ) Notice: Subject to any disclaimer, the term of this patent is extended or adjusted under 35 U.S.C. 154(b) by 164 days.

(21) Appl. No.: 11/012,141

(22) Filed: Dec. 16, 2004

(65) Prior Publication Data

US 2005/0150509 A1 Jul. 14, 2005

Related U.S. Application Data

(60) Provisional application No. 60/539,116, filed on Jan. 27, 2004.

(30) Foreign Application Priority Data

Dec. 16, 2003 (FR) ..... 03 51079

(51) Int. Cl.
*A45D 2/48* (2006.01)

(52) U.S. Cl. ..... 132/217

(58) Field of Classification Search ..... 132/216–218, 132/227, 229, 241, 271, 269, 243; 219/222, 219/223, 225, 227–229; 401/1, 2
See application file for complete search history.

(56) References Cited

U.S. PATENT DOCUMENTS 4,964,429 A * 10/1990 Cole ..... 132/218
5,853,010 A 12/1998 Suh
5,927,295 A * 7/1999 Quinones ..... 132/216
5,944,028 A * 8/1999 Gebhard ..... 132/216
6,009,884 A 1/2000 Suh
6,220,252 B1 4/2001 Heintz
6,412,496 B1 * 7/2002 Gueret ..... 132/218
6,539,950 B1 4/2003 Gueret
6,581,610 B1 6/2003 Gueret
2002/0023658 A1 2/2002 Gueret

FOREIGN PATENT DOCUMENTS

EP 0 848 920 A1 6/1998
FR 935 276 6/1948
FR 2 743 991 8/1997
JP 2001-120333 * 5/2001

(Continued)

OTHER PUBLICATIONS

Database WPI, Derwent Publications Ltd., London, GB; AN 2003-839073, XP002275974.

(Continued)

*Primary Examiner*—Robyn Doan
*Assistant Examiner*—Rachel A Running
(74) *Attorney, Agent, or Firm*—Finnegan, Henderson, Farabow, Garrett & Dunner, L.L.P.

(57) ABSTRACT

A device for separating and curling eyelashes may include a heater member and at least one row of projecting elements defining spaces configured to receive eyelashes. The projecting elements may be configured to separate the eyelashes. The heater member and the row of projecting elements may be configured such that the projecting elements selectively either separate the eyelashes without the eyelashes contacting the heater member, or curl the eyelashes while subjecting the eyelashes to heat from the heater member.

50 Claims, 5 Drawing Sheets

FOREIGN PATENT DOCUMENTS

| | | | |
|---|---|---|---|
| JP | 2002-125753 | | 5/2002 |
| JP | 2003-310335 | * | 11/2003 |
| JP | 2003-310336 | * | 11/2003 |
| WO | WO 99/22782 | | 5/1999 |
| WO | WO 00/40112 | | 7/2000 |

OTHER PUBLICATIONS

Database WPI, Derwent Publications Ltd., London, GB; AN 2003-839074, XP002275975.
Patent Abstracts of Japan, vol. 1999, No. 08, Jun. 30, 1999.
English-language Abstract of FR 2 743 991, no date provided.

* cited by examiner

DEVICE AND METHOD FOR CURLING EYELASHES

This application claims the benefit of priority under 35 U.S.C. § 119(e) of U.S. provisional application No. 60/539,116, filed on Jan. 27, 2004, the disclosure of which is incorporated herein by reference.

The present invention relates to devices for curling eyelashes. For example, the present application relates to devices for curling eyelashes including a heater member.

Examples of some conventional devices for curling eyelashes are disclosed in U.S. Pat. Nos. 5,853,010, 6,009,884, and 6,220,252. These conventional devices, however, may not be satisfactory, for example, for curling eyelashes on which mascara has previously been applied, since under the effect of heat, mascara tends to liquefy and/or fuse, so that the eyelashes may tend to clump together, which may detract from the desirability of the make-up effect. Furthermore, some of the eyelashes may also be curled in a manner that is not sufficiently progressive.

International application WO 99/22782 discloses an apparatus for dressing eyelashes comprising a heat generating device. The apparatus is not being designed to allow the brush to be used without being heated, while the heat generating device is hot.

Application EP 0 848 920, international application WO 00/40112, and Japanese applications JP 2003-310335, JP 2003-310336, and JP 1-056444 relate to devices for curling the eyelashes that do not have projecting elements for separating the eyelashes without subjecting them to the heat given off by a heating element.

There may exist a need to curl eyelashes without the curling being detrimental to the quality of make-up effect.

The invention may seek to satisfy the above-mentioned need.

Although the present invention may obviate the above-mentioned need, it should be understood that some aspects of the invention might not necessarily obviate the above-mentioned need.

In the following description, certain aspects and embodiments will become evident. It should be understood that the invention, in its broadest sense, could be practiced without having one or more features of these aspects and embodiments. It should be understood that these aspects and embodiments are merely exemplary.

In one aspect, as embodied and broadly described herein, the invention includes a device for separating and curling eyelashes. The device may include a heater member and at least one row of projecting elements defining spaces configured to receive eyelashes. The projecting elements may be configured to separate the eyelashes. The heater member and the row of projecting elements may be configured such that the projecting elements selectively either separate the eyelashes without the eyelashes contacting the heater member, or curl the eyelashes while subjecting the eyelashes to heat from the heater member. The device may not be configured to close a receptacle containing a product for being applied to the eyelashes. The projecting elements may remain secured in use to the heater member.

In another aspect, the device may not include a skirt configured to fix the device onto a receptacle. For example, the device may not include an internally threaded skirt configured to fix the device onto a receptacle.

In yet another aspect, the device may include a handle member and a head including the heater member and the at least one row of projecting elements. The device may not include a circularly cylindrical rod extending between the handle member and the head.

In a further aspect, the device may not include a wiper.

In still another aspect, the device may include a cap. For example, the cap may be configured to be mounted on the device via snap-fastening. The cap may be internally empty and/or transparent.

According to another aspect, the device may render it possible to substantially reduce the risk of clumping of the eyelashes and/or the device may improve the quality of makeup effect.

In a further aspect, a device for separating and curling eyelashes may include a support, a heater member associated with the support, and at least one row of projecting elements defining spaces configured to receive eyelashes. The projecting elements may be configured to separate the eyelashes. The heater member and the row of projecting elements may be configured such that the projecting elements selectively either separate the eyelashes without the eyelashes contacting the heater member, or curl the eyelashes while subjecting the eyelashes to heat from the heater member and while the eyelashes are received in the spaces between the projecting elements. The at least one row of projecting elements may be formed via molding material together with the support.

In yet another aspect, a device for separating and curling eyelashes may include a heater member defining a generally curved axis and at least one row of projecting elements extending along a generally curved axis extending substantially parallel to the generally curved axis of the heater member. The projecting elements may define spaces between one another configured to receive eyelashes. The projecting elements may be being configured to separate the eyelashes, and the heater member and the row of projecting elements may be configured such that the projecting elements selectively either separate the eyelashes without the eyelashes contacting the heater member, or curl the eyelashes while subjecting the eyelashes to heat from the heater member.

According to still another aspect, a device for separating and curling eyelashes may include a heater member and at least one row of projecting elements defining spaces between one another configured to receive eyelashes. The projecting elements may be configured to separate the eyelashes. The device may further include a cap configured to protect the projecting elements and to keep the projecting elements substantially dry when not in use. The projecting elements may be secured to the heater member, and the heater member and the row of projecting elements may be configured such that the projecting elements selectively either separate the eyelashes without the eyelashes contacting the heater member, or curl the eyelashes while subjecting the eyelashes to heat from the heater member.

As used herein, the term "keeping substantially dry" means to prevent from being immersed in a liquid and/or semi-liquid substance, for example, the projecting elements may be covered by a cap that is not filled with a substance for application to the eyelashes.

According to another aspect, a heater member may define a length and the at least one row of projecting elements may extend substantially parallel to the heater member over at least a portion of the length of the heater member. For example, the at least one row of projecting elements may extend all along one side the heater member.

In still another aspect, the heater member may be configured to be heated via electricity. According to still a further aspect, the heater member may be heated at at least one end, and heat may propagate via conduction along substantially the entire length of the heater member.

According to a further aspect, the device may include a number of projecting elements sufficient to enable the eyelashes to be separated. For example, the at least one row of projecting elements may include at least seven projecting elements. For example, the at least one row of projecting elements may include a number of projecting elements ranging from about 7 to about 30. According some aspect, the at least one row of projecting elements may include a number of projecting elements ranging from about 7 to about 35.

In still another aspect, the projecting elements may define a length sufficient to separate eyelashes. For example, the projecting elements may define a length ranging from about 1 millimeter to about 15 millimeters. For example, the projecting elements may define a length ranging from about 3 millimeters to about 10 millimeters.

According to a further aspect, the device may include two rows of projecting elements located on opposite sides of the heater member. For example, the heater member may define a midplane of symmetry defining a longitudinal axis, and the two rows of projecting elements may be located symmetrically about the midplane of symmetry. The presence of two rows of projecting elements may render it possible, for example, for the device to be used equally well by either left-handed users or right-handed users.

In yet another aspect, the projecting elements may include teeth formed via molding a plastics material. In still a further aspect, the device may include a support, and the projecting elements may include teeth formed via molding a plastics material integrally with the support. According to yet another aspect, the heater member may be associated with the support.

According to still a further aspect, free ends of the projecting elements may be arranged in a line that is outwardly concave and configured to follow an eyelid curvature.

In yet another aspect, the heater member may extend along an outwardly concave, curvilinear longitudinal axis.

In another aspect, the device may define a longitudinal midplane, and the projecting elements may have free ends projecting toward the longitudinal midplane.

According to a further aspect, the device may define a longitudinal midplane, and the projecting elements may have free ends projecting away from the longitudinal midplane. In another aspect, the device may define a longitudinal midplane, and the projecting elements may project in a direction substantially parallel to the longitudinal midplane.

In still a further aspect, the projecting elements may define spaces between one another as viewed from a side perpendicular to a longitudinal axis defined by the device. For example, the spaces may define V-shaped grooves. In yet a further aspect, the projecting elements may each define a shape that tapers towards free ends of the projecting elements. In still another aspect, the projecting elements may be oriented obliquely relative to the longitudinal axis of the device. For example, the projecting elements may cross one another when the device is viewed from the side.

According to still a further aspect, the projecting elements may be formed from a plastics material configured to withstand a maximum temperature reached by the heater member. This may render it possible, for example, to avoid any need to use any special thermal insulation between the heater member and the projecting elements and/or between the heater member and a support for the projecting elements (e.g., a support formed integrally with the projecting elements). For example, the projecting elements may be formed from thermoplastic elastomers.

According to a further aspect, the device may include an electrical power supply associated with the heater member. For example, the electrical power supply may include, for example, at least one electric battery and/or rechargeable battery.

In still another aspect, a device for separating and curling eyelashes may include a head defining a face. The device may include a heater member extending on the face. The device may include at least one row of projecting elements defining spaces, the spaces being configured to receive the eyelashes. The row of projecting elements may be secured to the heater member and may extend entirely on only one side of the heater member on the face. For example, the face may be concave adjacent to the projecting elements.

According to another aspect, a device for separating and curling eyelashes may include a heater member and at least one row of projecting elements secured to the heater member. The at least one row of projecting elements may include at least seven projecting elements, for example, configured such that eyelashes may be received between the projecting elements (e.g., engaged between the projecting elements) without contacting the heater member. The device may not be configured to close a receptacle containing a substance for application to the eyelashes.

In still another aspect, a device for separating and curling eyelashes may include a heater member and at least one row of projecting elements defining spaces between one another configured to receive eyelashes. The projecting elements may be configured to separate the eyelashes. The device may define a longitudinal midplane and at least some of the projecting elements may define free ends facing away from the longitudinal midplane. For example, the free ends may point away from the longitudinal midplane point in a direction defining an angle with respect to the midplane ranging from about 10 degrees to about 45 degrees (e.g., ranging from about 15 degrees to about 40, for example, ranging from about 20 degrees to about 35 degrees (e.g., about 25 degrees)).

According to yet another aspect, a method of curling eyelashes may include applying mascara to the eyelashes, providing a device for separating and curling eyelashes, separating the eyelashes using at least one row of projecting elements without subjecting the eyelashes (e.g., for any length of time) to heat given off by the heater member, and curling the eyelashes while subjecting them to the heat given off by the heater member.

The term "providing" is used in a broad sense, and refers to, but is not limited to, making available for use, enabling usage, giving, supplying, obtaining, getting a hold of, acquiring, purchasing, manufacturing, selling, distributing, possessing, making ready for use, and/or placing in a position ready for use.

In yet a further aspect, a device may include a portion carrying the heater member and at least one projecting element may be associated with the portion. For example, at least one row of projecting elements may be associated with the portion.

In still another aspect, the device may include two lateral portions and a central portion, and each lateral portion may be associated with a row of projecting elements. For example, the lateral portions may be associated with the central portion. According to a further aspect, the heater member may be associated with the central portion.

According to another aspect, the projecting elements of a row of projecting elements may define a geometrical separation surface and the projecting elements of the row of projecting elements may extend in alternating fashion on either side of the geometrical separation surface.

In still a further aspect, a device may include a support defining a generally outwardly concave face.

In yet another aspect, a device may include ribs configured to substantially prevent eyelids from contacting the heater member. For example, the ribs may extend generally transversely relative to a longitudinal axis defined by the device. According to another aspect, the ribs may define a rounded top edge.

In a further aspect, the heater member may not define spaces in which eyelashes become engaged.

In still another aspect, a device may include two rows of projecting elements disposed on either side of a heater member. Each row of projecting elements may define a geometrical separation surface and the projecting elements of each row of projecting elements may extend in alternating fashion on either side of their corresponding geometrical separation surface. The device may include a support defining a generally outwardly concave face associated with the projecting elements and ribs configured to substantially prevent eyelids from contacting the heater member. The ribs may extend generally transversely relative to a longitudinal axis defined by the device, and the ribs may define a rounded top edge.

According to still a further aspect, a device may include two rows of projecting elements disposed on either side of a heater member. The projecting elements of each row of projecting elements may be substantially aligned with one another. The device may include a support defining a generally outwardly concave face associated with the projecting elements, and ribs configured to substantially prevent eyelids from contacting the heater member. The ribs may extend generally transversely relative to a longitudinal axis defined by the device, and the ribs may define a rounded top edge.

According to yet another aspect, a device for separating and curling eyelashes may include a heater member configured to supply sufficient heat for curling eyelashes when activated, and at least one row of projecting elements configured to engage and separate eyelashes. The heater member and the at least one row of projecting elements may be configured such that when the heater member is activated, the device is configured to selectively either separate the eyelashes without the eyelashes contacting the heater member and without the heater member supplying sufficient heat to the eyelashes to substantially curl the eyelashes, or curl the eyelashes while subjecting the eyelashes to sufficient heat to curl the eyelashes via contact with the heater member.

In still a further aspect, a device for separating and curling eyelashes may include a heater member. The heater member may include an at least partially exposed wire configured to supply sufficient heat to curl eyelashes when activated. The device may further include at least one row of projecting elements defining spaces configured to receive eyelashes. The projecting elements may be configured to separate the eyelashes. The heater member and the row of projecting elements may be configured such that when the heater member is activated, the device is configured to selectively either separate the eyelashes without the eyelashes contacting the heater member, or curl the eyelashes while subjecting the eyelashes to heat from the heater member via contact with the at least partially exposed heater member.

According to another aspect, a device for separating and curling eyelashes may include a heater member configured to supply sufficient heat for curling eyelashes when activated and at least one row of projecting elements configured to engage and separate eyelashes. The projecting elements may define a length sufficient to separate eyelashes. The device may further include a plurality of ribs configured to substantially prevent the heater member from contacting eyelids. The plurality of ribs may define a length less than the length of the projecting elements. The heater member and the at least one row of projecting elements may be configured such that when the heater member is activated, the device is configured to selectively either separate the eyelashes without the eyelashes contacting the heater member and without the heater member supplying sufficient heat to the eyelashes to substantially curl the eyelashes, or curl the eyelashes while subjecting the eyelashes to sufficient heat to curl the eyelashes via contact with the heater member.

According to yet another aspect, a method of separating and curling eyelashes may include separating the eyelashes via at least one projecting element without subjecting the eyelashes to sufficient heat to curl the eyelashes, and curling the eyelashes via heat sufficient to curl to the eyelashes. In still another aspect, curling the eyelashes may include contacting a heater member to the eyelashes.

Aside from the structural and procedural arrangements set forth above, the invention could include a number of other arrangements, such as those explained hereinafter. It is to be understood, that both the foregoing description and the following description are exemplary.

The accompanying drawings are incorporated in and constitute a part of this specification. The drawings illustrate exemplary embodiments of the invention and, together with the description, serve to explain some principles of the invention. In the drawings, FIG. 1 is a schematic perspective view one embodiment of a device for curling eyelashes;

Figure 21:
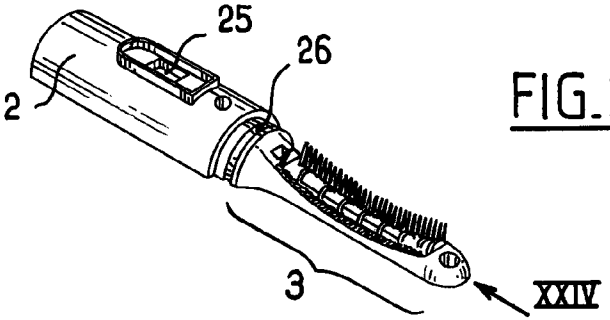
Figure 22:
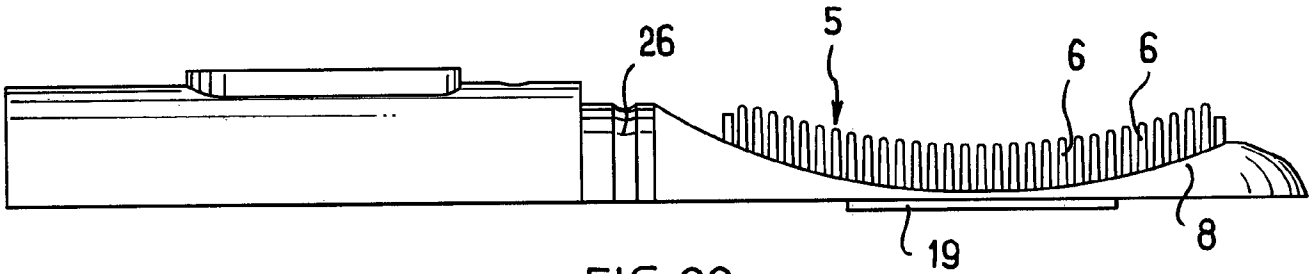
Figure 23:
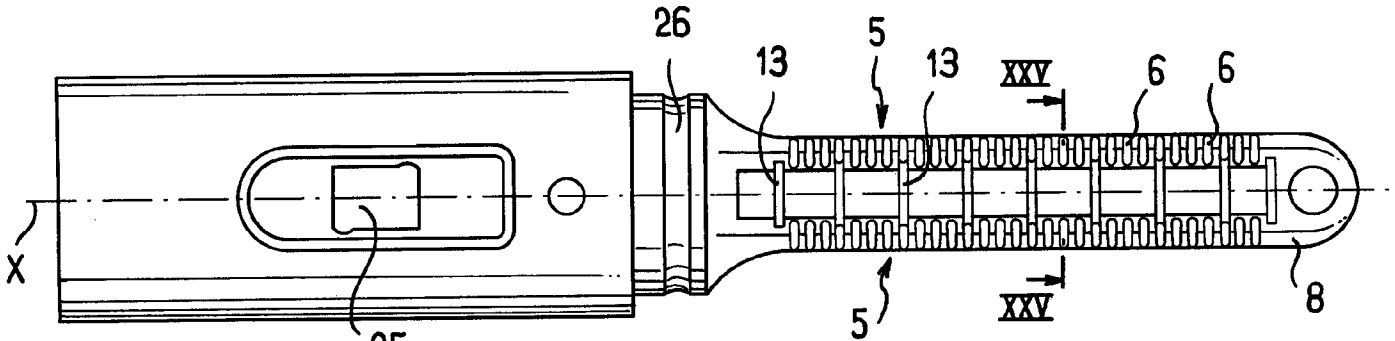
Figure 24:
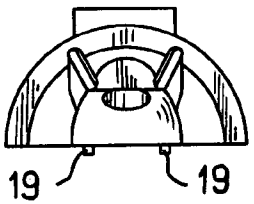
Figure 25:
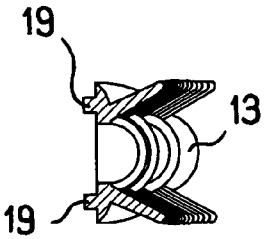
Figure 26:
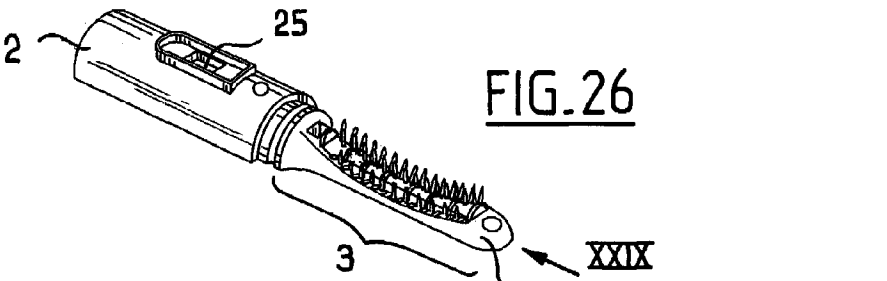
Figure 27:
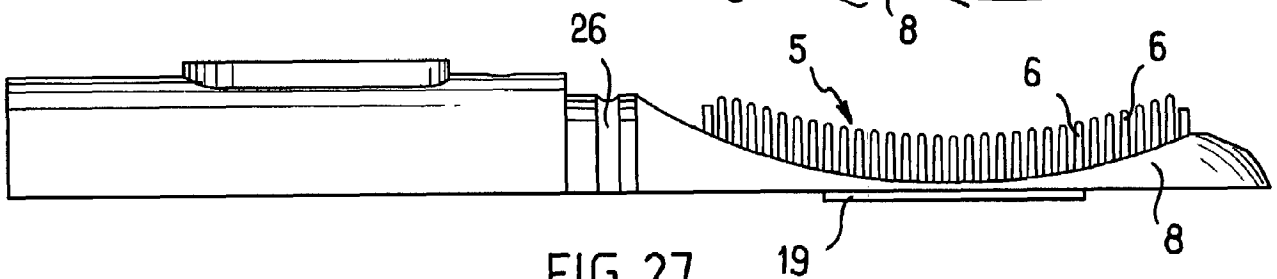
Figure 28:
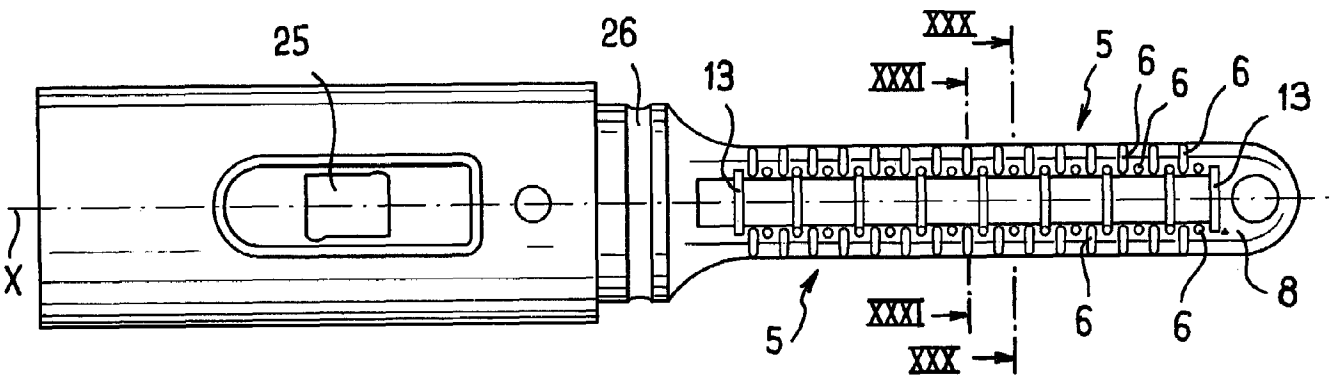
Figure 29:
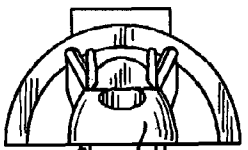
Figure 30:
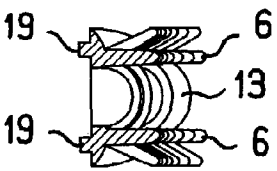
Figure 31:
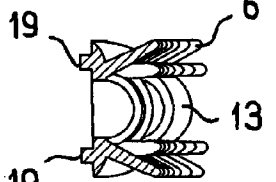
Figure 32:
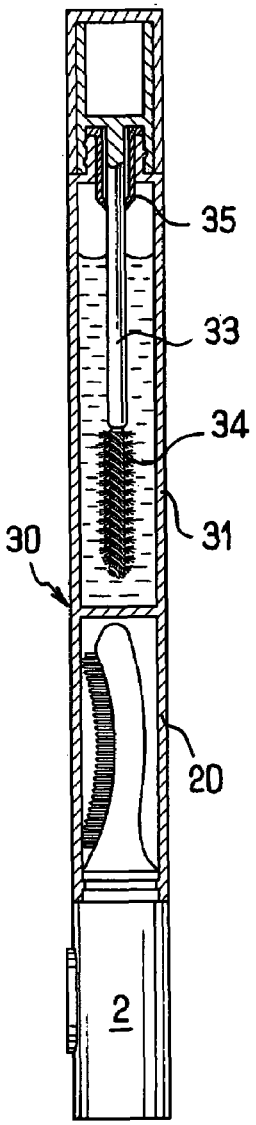
Figure 33:
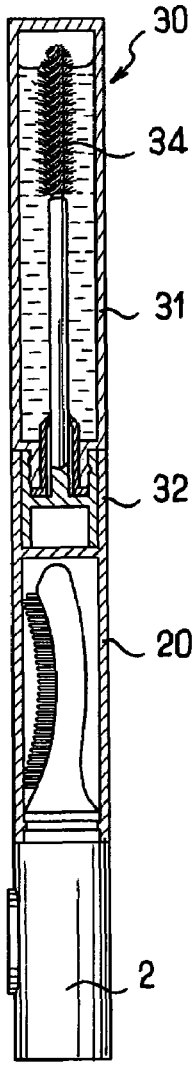
Figure 34:
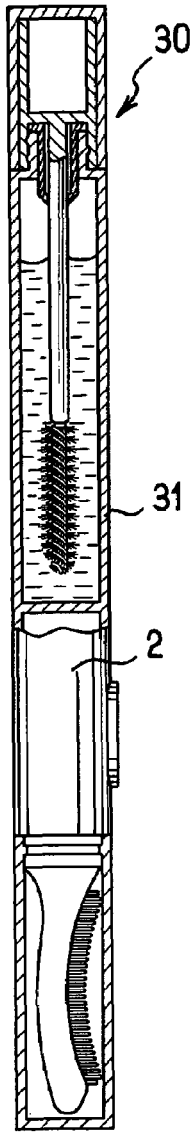
Figure 35:
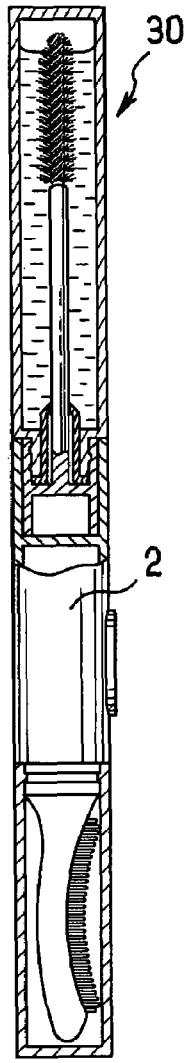
Figure 36:
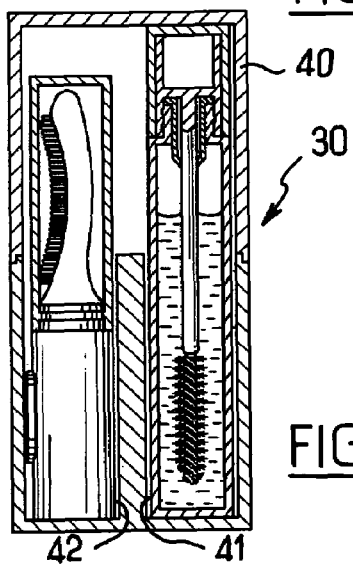

FIG. 21 schematic, partial perspective view of another embodiment of a device;

FIG. 22 is a schematic, partial side view of the device of FIG. 21;

FIG. 23 is a schematic, partial plan view of the device of FIG. 21;

FIG. 24 is a schematic section view along XXIV of FIG. 21;

FIG. 25 is a schematic section view along line XXV-XXV of FIG. 23;

FIG. 26 is a schematic, partial perspective view of a further embodiment of a device;

FIG. 27 is a schematic, partial side view of the device of FIG. 26;

FIG. 28 is a schematic, partial plan view of the device of FIG. 26;

FIG. 29 is a schematic section view along XXIX of FIG. 26;

FIG. 30 is a schematic section view along line XXX-XXX of FIG. 28;

FIG. 31 is a schematic section view along line XXXI-XXXI of FIG. 28;

FIG. 32 is a schematic, partial cross-section view of a further embodiment of a device;

FIG. 33 is a schematic, partial cross-section view of another embodiment of a device;

FIG. 34 is a schematic, partial cross-section view of a further embodiment of a device;

FIG. 35 is a schematic, partial cross-section view of another embodiment of a device; and FIG. 36 is a schematic, partial cross-section view of a further embodiment of a device.

Reference will now be made in detail to some possible embodiments of the invention, examples of which are illustrated in the accompanying drawings. Wherever possible, the same reference numbers are used in the drawings and the description to refer to the same or like parts.

Figure 1:
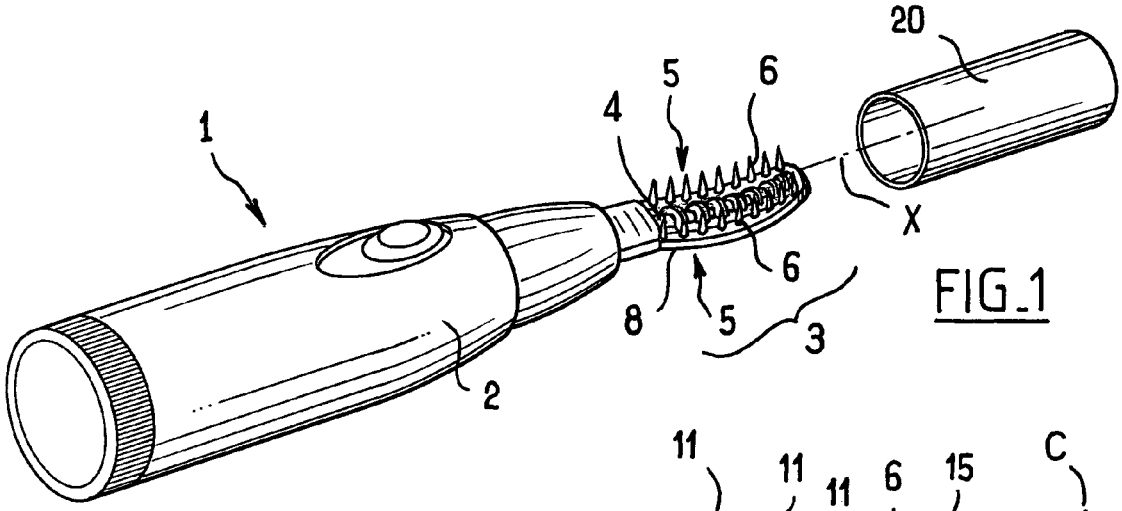

FIG. 1 depicts an exemplary embodiment of a device 1 including a housing 2 containing an electrical power supply and a head 3 defining a longitudinal axis X and including a heater member 4 and at least one row 5 of projecting elements 6, for example, two rows 5 of projecting elements 6. For example, the electrical power supply may include one or more batteries and/or rechargeable batteries.

Figure 3:
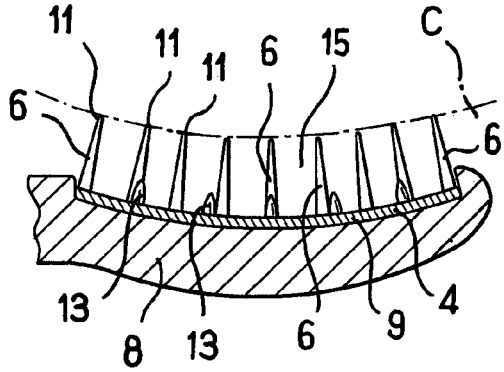
FIG. 3 is a schematic, partial section view along line III-III of FIG. 2.

Referring to FIG. 3, head 3 may include a support 8 defining a face 9 that may be generally outwardly concave. When not in use, the head 3 may be protected by a cap 20, which may be fixed to the housing 2 (e.g., via at least one of a tight fit, screw-fastening, and snap-fastening). For example, the cap 20 may be transparent.

Figure 4:
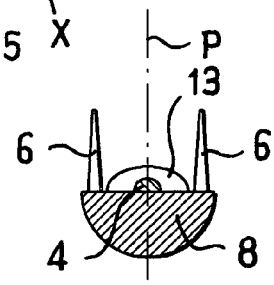
FIG. 4 is a schematic, partial section view along line IV-IV of FIG. 2.
Figure 5:
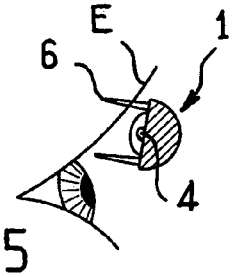
FIG. 5 is a schematic elevation view of a portion of an exemplary method of separating eyelashes.

The heater member 4 may extend along a curvilinear axis lying in a midplane P, for example, in contact with the face 9, as shown schematically in FIG. 4. One or more rows 5 may include a plurality of projecting elements 6 (e.g., teeth), which may be formed integrally via molding, for example, via molding the same or similar plastics material as is used for forming the support 8. In some examples, each projecting element 6 may extend substantially transversely to the longitudinal axis X. For example, each projecting element 6 may include a base connected to the face 9, although the projecting elements 6 could be connected to the support 8 via some other manner. For example, projecting elements 6 could extend from opposite side faces of the support 8.

Figure 2:
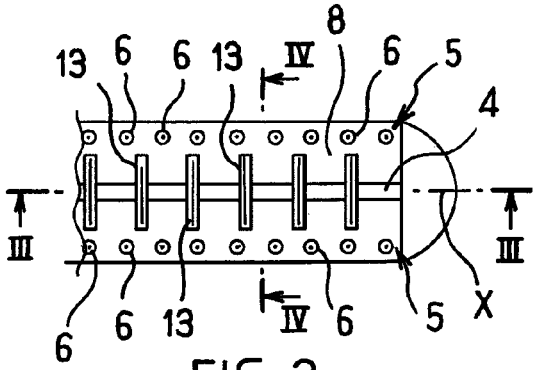
FIG. 2 is schematic, partial plan view of the embodiment of FIG. 1.

As depicted in FIG. 3, free ends 11 of the projecting elements 6 of each row 5 may lie along a curve C that is outwardly concave and that substantially matches, for example, the curvature of the eyelids. In the example shown in FIG. 2, all of the projecting elements 6 in a given row 5 are substantially in alignment parallel to the longitudinal axis X, and the two rows 5 may be disposed on either side of the heater member 4, for example, substantially symmetrical with respect to each other about the midplane P.

According to some exemplary embodiments, the maximum temperature of the heater member 4 may range, for example, from about 30 degrees C. to about 90 degrees C., for example, from about 35 degrees C. to about 70 degrees C. (e.g., from about 40 degrees C. to about 60 degrees C.). The heater member 4 may include, for example, a nichrome wire.

According to some exemplary embodiments, the support 8 may include one or more ribs 13, for example, to substantially protect eyelids from contacting the heater member 4. For example, as shown in FIG. 3, the ribs 13 may be relatively short in length compared with the length of the projecting elements 6 (e.g., the ribs may have a maximum length that is less than or equal to about one-fourth of the length of one or more of the projecting elements 6). The ribs 13 may extend generally transversely relative to the longitudinal axis X, and/or they may have rounded top edges. According to some embodiments, one or more of the ribs 13 may contribute to retaining the heater member 4 on the support 8.

The number of projecting elements 6 included in a given row 5 may range from about 7 to about 30, for example, from about 7 to about 35. The number of projecting elements 6 may be selected such that the row 5 of projecting elements 6 in the row 5 is configured to separate eyelashes. For example, the number of projecting elements 6 in a row 5 may be 9, for example, as shown in FIG. 3. Alternatively, the number of projecting elements in a given row 5 may be greater than 9 (e.g., 11 or more). The number of projecting elements 6 may be greater than the number of ribs 13 (i.e., when the device 1 includes ribs 13) and/or other elements that may be used for retaining the heater member 4 with the support 8 (e.g., via overlying the heater member 4).

In the example shown in FIGS. 1-4, the heater member 4 does not define spaces in which the eyelashes could become engaged, which might be the case, for example, if the heater member 4 included a helical coil of non-touching turns which might render it possible for the eyelashes to engage between the turns.

According to some exemplary embodiments, two consecutive projecting elements 6 in the same row 5 may define between them an outwardly-open space 15 into which it may be possible to engage at least one eyelash while the device 1 is in use. The height of the space 15 may be defined by the length of the projecting elements 6, and/or the projecting elements 6 may define a length ranging from about 1 millimeter to about 15 millimeters, for example, from about 3 millimeters to about 10 millimeters.

FIGS. 5 through 8 depict exemplary ways in which the device 1 may be used. For example, after a substance such as, for example, mascara has already been applied to the eyelashes E using an applicator that is not shown, the device 1 may be used to at least one of separate and curl the eyelashes. It is contemplated, however, that the device 1 may be used without any substance being previously applied to the eyelashes.

The device 1 may be used by a user, for example, to separate the eyelashes E (e.g., prior to other steps) using at least one of the rows 5 of projecting elements 6. The eyelashes E may not become engaged in another row 5 of projecting elements 6, which may be situated beside the eye, as shown in the example depicted in FIG. 5. The eyelashes E may not be subjected to heat given off by the heater member 4. For example, the heater member 4 may be configured to be activated to supply heat to the eyelashes E in order, for example, to curl the eyelashes E. When a user separates the eyelashes via at least one of the rows 5 of the projecting elements 6, the eyelashes E may not be subjected to a sufficient amount of heat supplied via the heater member 4 to substantially curl the eyelashes E, for example, so that the heater member 4 does not contact eyelashes E.

Figure 6:
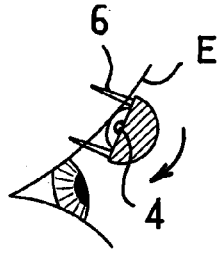
FIG. 6 is a schematic elevation view of a portion of an exemplary method of separating eyelashes.

As shown in FIG. 6, for example, after separating the eyelashes E, and while keeping the eyelashes E engaged between the projecting elements 6, the user may move the heater member 4 toward the eyelashes E, so as to subject them to the heat supplied (e.g., given off) by the heater member 4.

Figure 7:
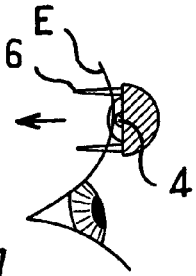
FIG. 7 is a schematic elevation view of a portion of an exemplary method of curling eyelashes.

As shown in FIG. 7, for example, after moving the heater member 4 toward the eyelashes E, the user may exert rearward thrust on the eyelashes E, for example, using the heater member 4 to curl the eyelashes E. The eyelashes E may remain substantially engaged between the projecting elements 6 during this operation, which may serve to reduce the possibility of the eyelashes E becoming bunched together, for example, by virtue of a substance (e.g., mascara) on the eyelashes E melting and/or fusing due to the heat supplied by the heater member 4.

Figure 8:
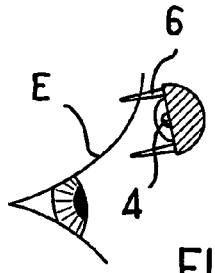
FIG. 8 is a schematic elevation view of a portion of an exemplary method of separating eyelashes.

Once the eyelashes E have been curled, they may be separated from one another by combing them with the projecting elements 6, for example, as shown in FIG. 8, while preventing the heater member 4 from contacting (and/or keeping it away from) the eyelashes E.

Figure 9:
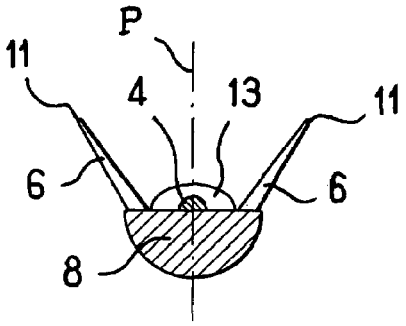
FIG. 9 is a schematic, partial section view of a further embodiment of a device.
Figure 10:
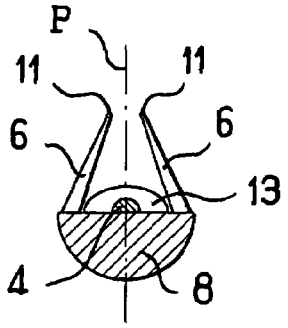
FIG. 10 is a schematic, partial section view of a further embodiment of a device.
Figure 11:
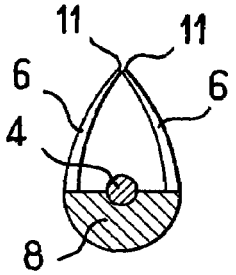
FIG. 11 is a schematic, partial cross-section view of a further embodiment of a device.

In the exemplary embodiment depicted in FIG. 4, the longitudinal axis of each of projecting elements 6 may be substantially parallel to the midplane P. In some embodiments, however, some or all of the projecting elements 6 need not extend substantially parallel to the midplane P. For example, as shown in FIG. 9, the projecting elements 6 of the two rows 5 have free ends 11 that point in directions away from the midplane P. In the exemplary embodiment shown in FIG. 10, the projecting elements 6 have free ends 11 that point toward the midplane P. In the exemplary embodiment shown in FIG. 11, the free ends 11 of the projecting elements 6 are situated substantially along a common axis (e.g., an axis parallel to the longitudinal axis of the support 8). In this embodiment, the projecting elements 6 may protect the eyelashes (and/or the eyelids) from contacting the heater member 4. The ribs 13 may (or may not) be omitted.

Figure 12:
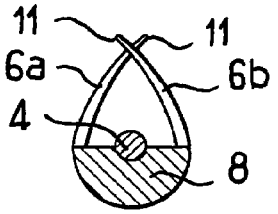
FIG. 12 is a schematic, partial cross-section view of a further embodiment of a device.
Figure 16:
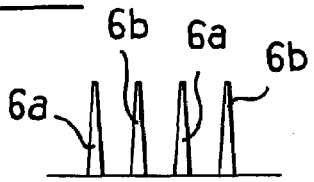
FIG. 16 is a schematic, partial elevation view of an embodiment of a portion of a device.

In the exemplary embodiment depicted in FIG. 12, the free ends 11 of the projecting elements 6 may cross as viewed looking along the head 3's longitudinal axis. For example, in order to render it relatively easier for the projecting elements 6 of the two rows 5 to cross, the projecting elements 6 may be disposed in a staggered configuration, for example, so that the projecting elements 6*a* of one row 5 are axially offset relative to the projecting elements 6*b* of the other row 5, as shown in FIG. 16.

Figure 13:
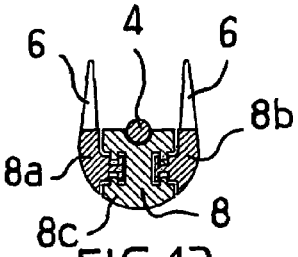
FIG. 13 is a schematic, partial cross-section view of another embodiment of a device.
Figure 15:
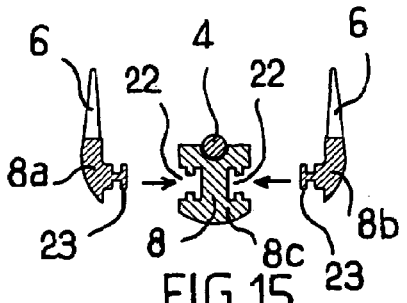
FIG. 15 is a schematic, partial cross-section, assembly view of the embodiment of FIG. 13.

According to some embodiments, the projecting elements 6 may be molded as a single piece together with the support 8, for example, as shown in FIG. 4. It may also be possible for the projecting elements 6 to be carried by lateral portions 8*a* and 8*b* that may be fitted onto a central portion 8*c* having the heater member 4 extending thereon, for example, as shown in FIG. 13. Each lateral portion 8*a* or 8*b* may be secured in various ways to the central portion 8*c*, for example, either removably or permanently. For example, the lateral portions 8*a* and 8*b* may be arranged to snap-fasten to opposite faces of the central portion 8*c*, as shown in FIG. 15, and for this purpose, the portions 8*a*, 8*b*, and 8*c* may have complementary portions in relief (e.g., grooves 22 in the central portion 8*c* and complementary ribs 23 on the lateral portions 8*a* and 8*b*, or vice versa). Other fastening arrangements could also be used, for example, slideways, adhesives, heat-sealing, and/or additional parts, may be used to fasten lateral portions 8*a* and/or 8*b* to central portion 8*c*. According to some embodiments, releasably fastening the lateral portions 8*a* and 8*b* may render it possible to select amongst different projecting elements 6, for example, in order to select projecting elements 6 that may be most suitable for the nature of the eyelashes and/or of the kind of makeup to be applied.

Figure 14:
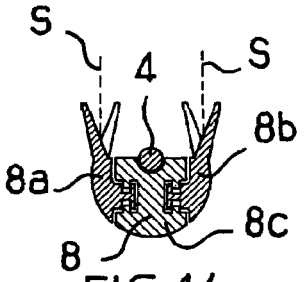
FIG. 14 is a schematic, partial cross-section view of a further embodiment of a device.

According to some embodiments, within a given row of projecting elements 5, all of the projecting elements 6 may be either fully aligned or only their bases may be aligned with the projecting elements 6 themselves projecting in alternation, for example, on either side of a geometrical separation surface S, as shown in FIG. 14.

Figure 17:
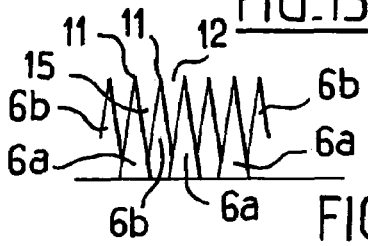
FIG. 17 is a schematic, partial elevation view of another embodiment of a portion of a device.
Figure 18:
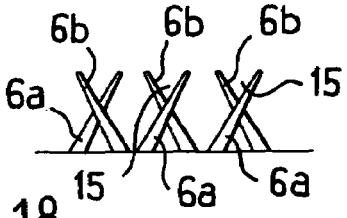
FIG. 18 is a schematic, partial elevation view of a further embodiment of a portion of a device.
Figure 19:
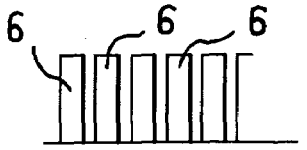
FIG. 19 is a schematic, partial elevation view of another embodiment of a portion of a device.
Figure 20:
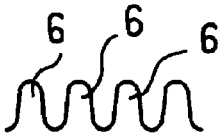
FIG. 20 is a schematic, partial elevation view of a further embodiment of a portion of a device.

The arrangement of the projecting elements 6 on the head 3 may be modified, for example, such that the projecting elements 6 may be shaped such that they taper towards their free ends 11, so as to form V-shaped grooves 15 between one another, as shown in FIG. 17. According to some embodiments, the projecting elements 6*a* of a row 5 may be formed such that they extend obliquely towards either a proximal or distal end of the device 1, while other projecting elements 6*b* of another row 5 extend in an opposite direction, so that between two of the oppositely extending projecting elements 6, a V-shaped groove 15 is formed, as shown in FIG. 18. In some embodiments, the projecting elements 6 may have free ends 11 that are not pointed, for example, they may have free ends 11 that are substantially flat, as shown in FIG. 19. The projecting elements 6 may be in the form of undulations, as shown in FIG. 20. Other examples of projecting elements are described in U.S. Pat. Nos. 6,412,496, 6,581,610, and 6,539,950, the contents of which are incorporated herein by reference.

The projecting elements 6 may define a wide variety of cross-sections. For example, they may have cross-sections that are circular, non-circular, oblong, polygonal, triangular, and/or square, although other cross-sectional shapes are contemplated.

The projecting elements 6 within a row 5 may or may not be in substantial alignment with one another.

According to some embodiments, the projecting elements 6 may include bristles rather than, or in addition to, teeth, for example, bristles at least similar to those found on some mascara brushes. The projecting elements 6 may be formed from a variety of plastics materials, for example, thermoplastic elastomers, thermosetting elastomers, and/or catalyzed resins. The material(s) forming the projecting elements 6 may be selected to withstand heat given off by the heater member 4.

The heater member 4 may be held in a variety of ways on the support 8, for example, the heater member 4 may be held at its two axial ends only, for example, via being partially embedded in the material of the support 8.

In the exemplary embodiment shown in FIG. 1, the housing 2 may be closed at its end remote from the head 3 via a plug, which, upon being opened, may provide access to the inside of the housing 2 (e.g., to render it possible for the heater member 4 and/or an electrical power supply to be installed, and/or to render it possible to change one or more batteries). It would not go beyond the ambit of the present invention for the housing 2 to be configured in some other way.

For example, FIGS. 21 through 25 and FIGS. 26 through 31 schematically depict two embodiments in which the casing 2 includes two half-shells. As shown in these figures, a top half-shell may include a head carrying the rows 5 of projecting elements 6, which may be secured to a bottom half-shell via, for example, fastener arrangements, which may include ribs 19 on one half-shell that may be configured to cooperate with complementary shapes in relief in the other half-shell. This may render it relatively easier to install an electrical power supply in a first half-shell and then to fasten the second half-shell thereto. Such a configuration may also render it relatively easier to manufacture the device 1, for example, by rendering it possible for one or more of the two half-shells to be injection-molded (e.g., each including a single part).

The housing 2 may be provided with an orifice 25 for receiving a button for controlling the electrical power supply. The housing 2 may also include an annular groove 26 configured to cooperate with a corresponding bead on a closure cap, for example, so as to enable the rows 5 of projecting elements 6 and the heater member 4 to be protected.

The exemplary projecting elements 6 of the rows 5 of the device 1 shown in FIGS. 21 through 25 may be connected to the support 8, so that their free ends extend away from a longitudinal midplane of the device 1. The longitudinal midplane of the device 1 is a plane parallel to the sheet of paper containing FIG. 22, and a plane perpendicular to the sheet of paper containing FIG. 23. For example, in the exemplary device 1 shown in FIGS. 21-25, it constitutes a plane of symmetry of the device 1.

In the exemplary embodiment shown in FIGS. 26 through 31, the projecting elements 6 of the rows 5 may be disposed, such that free ends of the projecting elements 6 in a given row 5 are oriented in alternation parallel to the midplane and extending away from the midplane. The projecting elements 6 in a given row 5 may extend alternately on either side of a geometrical separation surface. Between the projecting elements 6, V-shaped grooves may be formed, as viewed along the longitudinal axis of the row 5. For example, the projecting elements 6 that extend away from the midplane, may form an angle relative to the midplane, which may range from about 10 degrees to about 45 degrees, for example, from about 15 degrees to about 40 degrees (e.g., from about 20 degrees to about 35 degrees, for example, about 25 degrees).

Each of the devices 1 shown in FIGS. 21 through 31 may include a support 8 having one face that is generally outwardly concave, with the projecting elements 6 connected to the face. In addition, each of the devices 1 shown in FIGS. 21 through 31 may include ribs 13 for substantially protecting the eyelid from contacting the heater member 4. The ribs 13 may extend generally transverse to the longitudinal axis X of the device 1 and may be generally circularly arcuate in shape, for example, the ribs may define semicircles overlying the heater member 4. In addition, the ribs 13 may define rounded top edges, for example, so as to render it relatively easier to move the device 1 relative to the eyelashes and/or the eyebrows.

The devices 1 shown in FIGS. 1 through 31 may be integrated in a housing rendering it possible for the user to apply mascara, to separate the eyelashes, and/or to subject them to the heat given off by the heater member 4. Such housings may be configured in various ways. For example, FIG. 32 shows a housing 30 in which the closure cap 20 of the device may be mounted on a receptacle 31 suitable for containing a care product, a cosmetic, and/or makeup (e.g., mascara). The receptacle 31 may be closed via a closure cap 32 having a first end of a rod 33 fastened thereto, while a second end of the rod 33 may carry an applicator member 34 (e.g., including a brush comprising a metal wire folded into a U-shape and twisted, with bristles of the brush being held in the twisted, metal wire). The device 1 may include a wiper member 35 configured to wipe the rod 33 and/or the applicator member 34.

According to some embodiments, the closure cap 20 may not be connected to the receptacle 31, but may be connected instead to the cap 32 configured to close the receptacle 31, as shown in FIG. 33. In some embodiments, for example, as shown in FIG. 34, the receptacle 31 may be connected to the housing 2 of the device 1, with the assembly including the housing 2 and the receptacle 31 containing the substance, so that receptacle 31 may be used as a handle for the device 1. In some embodiments, for example, as shown in FIG. 35, the closure cap 32 of the receptacle 31 may be connected to the housing 2 of the device 1.

The term "connected" is used to mean connected in a manner that is optionally removable (e.g., not being made integrally therewith (e.g., not being molded as a single piece of plastics material)).

According to some embodiments, the device 1 may include a closure cap 20, and a receptacle 31 may be configured to be closed by a closure cap 32. The device 1 and the receptacle 31 may be independent from one another, and both the device 1 and the receptacle 31 may be contained in a common case 40 (e.g., in two distinct housings 41 of the case 40), as shown in FIG. 36.

One or more of the devices 1 shown in FIGS. 32 through 36 may render it possible for the user to relatively more easily apply substance to the eyelashes, and then curl the eyelashes, with it being possible to perform these two operations either in succession or independently of one another.

Sizes of various structural parts and materials used to make the above-mentioned parts are illustrative and exemplary only, and one of ordinary skill in the art would recognize that these sizes and materials can be changed to produce different effects or desired characteristics.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A device for separating and curling eyelashes, the device extending longitudinally along a longitudinal axis and defining a midplane including the longitudinal axis, the device comprising:

a heater member; and at least two rows of projecting elements disposed on either side of the heater member and defining spaces configured to receive eyelashes, the projecting elements being configured to separate the eyelashes, wherein the heater member and the rows of projecting elements are configured such that the projecting elements selectively either separate the eyelashes without the eyelashes contacting the heater member, or curl the eyelashes while subjecting the eyelashes to heat from the heater member, wherein the device is not configured to close a receptacle containing a product for being applied to the eyelashes, wherein the heater member extends longitudinally in the midplane, and wherein at least some of the projecting elements define free ends projecting away from the longitudinal midplane.

2. The device of claim 1, wherein the heater member defines a length and at least one row of projecting elements extends substantially parallel to the heater member over at least a portion of the length of the heater member.

3. The device of claim 1, wherein at least one row of projecting elements extends entirely along one side of the heater member.

4. The device of claim 1, wherein the device does not include a skirt configured to fix the device onto a receptacle.

5. The device of claim 1, wherein the device does not include an internally threaded skirt configured to fix the device onto a receptacle.

6. The device of claim 1, further comprising a handle member and a head comprising the heater member and at least one row of projecting elements, wherein the device does not include a circularly cylindrical rod extending between the handle member and the head.

7. The device of claim 1, wherein the device does not include a wiper.

8. The device of claim 1, wherein the heater member is configured to be heated via electricity.

9. The device of claim 1, wherein at least one row of projecting elements comprises at least seven projecting elements.

10. The device of claim 1, wherein at least one row of projecting elements comprises a number of projecting elements ranging from about 7 to about 35.

11. The device of claim 1, wherein the two rows of projecting elements are located symmetrically about the midplane.

12. The device of claim 1, wherein the projecting elements comprise teeth formed via molding a plastics material.

13. The device of claim 1, further comprising a support, wherein the projecting elements comprise teeth formed via molding a plastics material integrally with the support.

14. The device of claim 13, wherein the heater member is associated with the support.

15. The device of claim 1, further comprising a portion carrying the heater member, wherein at least one projecting element is associated with the portion.

16. The device of claim 15, wherein at least one row of projecting elements is associated with the portion.

17. The device of claim 1, further comprising two lateral portions and a central portion, wherein each lateral portion is associated with a row of projecting elements and the lateral portions are associated with the central portion.

18. The device of claim 17, wherein the heater member is associated with the central portion.

19. The device of claim 1, wherein the projecting elements define a length ranging from about 1 millimeter to about 15 millimeters.

20. The device of claim 1, wherein the projecting elements define a length ranging from about 3 millimeters to about 10 millimeters.

21. The device of claim 1, wherein free ends of the projecting elements are arranged in a line that is outwardly concave and configured to follow an eyelid curvature.

22. The device of claim 1, wherein the heater member extends along an outwardly concave, curvilinear longitudinal axis.

23. The device of claim 1, wherein all the projecting elements define free ends projecting away from the longitudinal midplane.

24. The device of claim 1, wherein the projecting elements define spaces between one another as viewed from a side perpendicular to the longitudinal axis of the device.

25. The device of claim 24, wherein the spaces define V-shaped grooves.

26. The device of claim 1, wherein the projecting elements are formed from a plastics material configured to withstand a maximum temperature reached by the heater member.

27. The device of claim 1, further comprising an electrical power supply associated with the heater member.

28. The device of claim 1, further comprising a cap.

29. The device of claim 28, wherein the cap is configured to be mounted on a portion of the device via snap-fastening.

30. The device of claim 1, wherein the projecting elements taper toward their free ends.

31. The device of claim 1, wherein projecting elements of a row of projecting elements define a geometrical separation surface, and the projecting elements of the row of projecting elements extend in alternating fashion on either side of the geometrical separation surface.

32. The device of claim 1, wherein the device comprises a support defining a generally outwardly concave face.

33. The device of claim 1, further comprising ribs configured to substantially prevent eyelids from contacting the heater member.

34. The device of claim 33, wherein the ribs extend generally transversely relative to a longitudinal axis defined by the device.

35. The device of claim 33, wherein the ribs define a rounded top edge.

36. The device of claim 1, wherein the heater member does not define spaces in which eyelashes become engaged.

37. The device of claim 1, wherein each row of projecting elements defines a geometrical separation surface, and wherein the projecting elements of each row of projecting elements extend in alternating fashion on either side of their corresponding geometrical separation surface;

the device further comprising:

a support defining a generally outwardly concave face associated with the projecting elements; and ribs configured to substantially prevent eyelids from contacting the heater member, the ribs extending generally transversely relative to a longitudinal axis defined by the device, and the ribs defining a rounded top edge.

38. The device of claim 1, wherein the projecting elements of each row of projecting elements are substantially aligned with one another;

the device further comprising:

a support defining a generally outwardly concave face associated with the projecting elements; and ribs configured to substantially prevent eyelids from contacting the heater member, the ribs extending generally transversely relative to a longitudinal axis defined by the device, and the ribs defining a rounded top edge.

39. A method of curling eyelashes, comprising:

applying mascara to the eyelashes;

providing the device of claim 1;

separating the eyelashes using the at least one row of projecting elements without subjecting the eyelashes to heat given off by the heater member; and curling the eyelashes while subjecting them to the heat given off by the heater member.

40. A method of curling eyelashes, comprising:

providing the device of claim 1; and curling the eyelashes while subjecting the eyelashes to heat given off by the heater member and while engaging the eyelashes between the projecting elements.

41. A device for separating and curling eyelashes, the device extending longitudinally along a longitudinal axis and defining a midplane including the longitudinal axis, the device comprising:

a heater member defining a generally curved axis; and at least two rows of projecting elements disposed on either side of the heater member and extending along a generally curved axis extending substantially parallel to the generally curved axis of the heater member, the projecting elements defining spaces between one another configured to receive eyelashes, the projecting elements being configured to separate the eyelashes, wherein the heater member and the rows of projecting elements are configured such that the projecting elements selectively either separate the eyelashes without the eyelashes contacting the heater member, or curl the eyelashes while subjecting the eyelashes to heat from the heater member, and wherein at least some of the projecting elements define free ends projecting away from the longitudinal midplane.

42. A device for separating and curling eyelashes, the device extending longitudinally along a longitudinal axis and defining a midplane including the longitudinal axis, the device comprising:

a heater member; and at least one row of projecting elements defining spaces between one another configured to receive eyelashes, the projecting elements being configured to separate the eyelashes, and wherein at least some of the projecting elements define free ends projecting away from the longitudinal midplane.

43. The device of claim 42, wherein the free ends facing away from the longitudinal midplane face in a direction defining an angle with respect to the midplane ranging from about 10 degrees to about 45 degrees.

44. The device of claim 43, wherein the angle ranges from about 15 degrees to about 40 degrees.

45. The device of claim 43, wherein the angle ranges from about 20 degrees to about 35 degrees.

46. A device for separating and curling eyelashes, the device extending longitudinally along a longitudinal axis and defining a midplane including the longitudinal axis, the device comprising:

a central portion on which a heater member configured to supply sufficient heat for curling eyelashes when activated extends; and at least one lateral portion different from the central portion, fitted onto the central portion and carrying at least one row of projecting elements configured to engage and separate eyelashes, wherein the heater member and the at least one row of projecting elements are configured such that when the heater member is activated, the device is configured to selectively either separate the eyelashes without the eyelashes contacting the heater member and without the heater member supplying sufficient heat to the eyelashes to substantially curl the eyelashes, or curl the eyelashes while subjecting the eyelashes to sufficient heat to curl the eyelashes via contact with the heater member, and wherein at least some of the projecting elements define free ends projecting away from the longitudinal midplane.

47. The device of claim 46, wherein at least one lateral portion is removably secured to the central portion.

48. The device of claim 46, wherein at least one lateral portion is permanently secured to the central portion.

49. A method of separating and curling eyelashes, the method comprising:

separating eyelashes via at least one projecting element without subjecting the eyelashes to sufficient heat to curl the eyelashes; and curling the eyelashes via heat sufficient to curl to the eyelashes.

50. The method of claim 49, wherein curling the eyelashes comprises contacting a heater member to the eyelashes.

* * * * *